US006392366B1

(12) United States Patent
Nerone

(10) Patent No.: US 6,392,366 B1
(45) Date of Patent: May 21, 2002

(54) TRAIC DIMMABLE ELECTRODELESS FLUORESCENT LAMP

(75) Inventor: Louis R. Nerone, Brecksville, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,557

(22) Filed: Sep. 19, 2001

(51) Int. Cl.[7] ..... G05F 1/00

(52) U.S. Cl. ..... 315/291; 315/194; 315/209 R; 315/244; 315/248; 315/DIG. 4

(58) Field of Search ..... 315/248, 291, 315/244, 194, 209 R, 205, 224, 344, DIG. 4, DIG. 7

(56) References Cited

U.S. PATENT DOCUMENTS

| | | | | | |
|---|---|---|---|---|---|
| 5,796,214 | A | * | 8/1998 | Nerone | 315/167 |
| 5,917,289 | A | * | 6/1999 | Nerone et al. | 315/209 R |
| 5,952,790 | A | * | 9/1999 | Nerone et al. | 315/209 R |
| 6,018,220 | A | | 1/2000 | Nerone | 315/219 |
| 6,051,934 | A | * | 4/2000 | Nerone | 315/209 R |
| 6,175,198 | B1 | | 1/2001 | Nerone | 315/291 |
| 6,218,788 | B1 | * | 4/2001 | Chen et al. | 315/224 |

* cited by examiner

*Primary Examiner*—Haissa Philogene
(74) *Attorney, Agent, or Firm*—Fay, Sharpe, Fagan, Minnich & McKee, LLP

(57) ABSTRACT

A ballast circuit for an electrodeless lamp designed to use a phase dimmer signal to control output of the electrodeless lamp. Dimming ballast circuit includes a rectifier circuit for rectifying an input voltage from a phase dimmer source to generate a pulsed d.c. voltage on a d.c. bus. Ballast circuit further includes a converter control circuit coupled to the rectifier circuit for inducing an r.f. a.c. load current at approximately 2.5 MHz. The converter circuit includes first and second complementary converter switches serially connected between the bus and a reference node. The switches are connected together at a common node through which the a.c. load current flows. A driving inductor is connected at one end to the common node and operatively connected at the remaining end to the control node. A load circuit includes a resonant inductor connected at one end to the common node, with the resonant inductor mutually coupled to the driving inductor. An r.f. inductor is connected at one end to the remaining end of the resonant inductor for generating an r.f. field for powering the electrodeless lamp. A resonant capacitor is serially connected between the remaining end of the r.f. inductor and an intermediate node. All capacitors are dry-type capacitors. The pulsed d.c. voltage causes the lamp to restart at twice the power line frequency.

16 Claims, 2 Drawing Sheets

TRAIC DIMMABLE ELECTRODELESS FLUORESCENT LAMP

BACKGROUND OF INVENTION

The present invention is directed to an electrodeless fluorescent lamp circuit and more particularly to such a circuit which is also dimmable.

Phase-controlled dimmable ballasts have gained a growing popularity in industry due to their capability for use with photo cells, motion detectors and standard wall dimmers.

In incandescent lamp dimming systems, dimming is controlled by a phase dimmer, also known as a triac dimmer. A common type of phase dimmer blocks a portion of each positive or negative half cycle immediately after the zero crossing of the voltage. The clipped waveform carries both the power and dimming signal to the loads. The dimmer replaces a wall switch which is installed in series with a power line.

Dimming of fluorescent lamps can be accomplished by regulating the lamp current, or regulating the average current feeding the inverter. For electrodeless fluorescent lamps (EFLs), the pulse width modulating (PWM) technique has been used to provide a dimmable lamp. The PWM technique pulses the EFLs at full rated lamp current thereby modulating intensity by varying the percentage of time the lamp is operating at full-rated current. The technique is simple and is a fixed frequency operation, however, it requires control of the ballast inverter circuit by means internal to the ballast, adding to the cost and complexity of the ballast circuit. Another method utilizing frequency-shift keying (FSK) to lower power output from an r.f. inductor is disclosed in U.S. Pat. No. 6,175,198 issued to Louis R. Nerone (the present inventor). This method also requires control of the ballast inverter circuit by means internal to the ballast, adding to the cost and complexity of the ballast circuit. The above-described systems typically require at least one voltage bus having a filtered d.c. voltage, thereby requiring one or more electrolytic capacitors, adding to the cost and reducing the life expectancy of the ballast.

SUMMARY OF INVENTION

In an exemplary embodiment of the present invention, a ballast circuit for an electrodeless lamp designed to use a phase dimmer signal to control output of the electrodeless lamp is provided. The dimming ballast circuit includes a rectifier circuit for rectifying an input voltage from a phase dimmer source. The rectifier circuit includes rectifier diodes connected in a bridge rectifier arrangement having a pair of input nodes connected to the phase dimmer output for generating a pulsed d.c. voltage on a d.c. bus. A converter control circuit is coupled to the rectifier circuit for inducing an r.f. a.c. load current. The converter includes first and second complementary converter switches serially connected between the bus and a reference node. The switches are connected together at a common node through which the a.c. load current flows. Each switch also has a control node connected to a common control node, the voltage between the control node and the common node determining the conduction state of each of the switches. The converter also includes a first resistor connected between the d.c. bus and the control node and a second resistor connected between the reference node and the control node. A driving inductor is connected at one end to the common node and operatively connected at the remaining end to the control node. A load circuit is provided, including a resonant inductor connected at one end to the common node, with the resonant inductor mutually coupled to the driving inductor for sensing a voltage across the resonant inductor. An r.f. inductor is connected at one end to the remaining end of the resonant inductor for generating an r.f. field for powering the electrodeless lamp. A resonant capacitor is serially connected to the remaining end of the r.f. inductor. The resonant capacitor is connected at the remaining end to an intermediate node, wherein the resonant capacitor is a non-electrolytic capacitor. First and second d.c. blocking capacitors are connected between the bus node and the reference node and are joined at the intermediate node with the resonant capacitor. The blocking capacitors are non-electrolytic capacitors.

DETAILED DESCRIPTION

Figure 1:
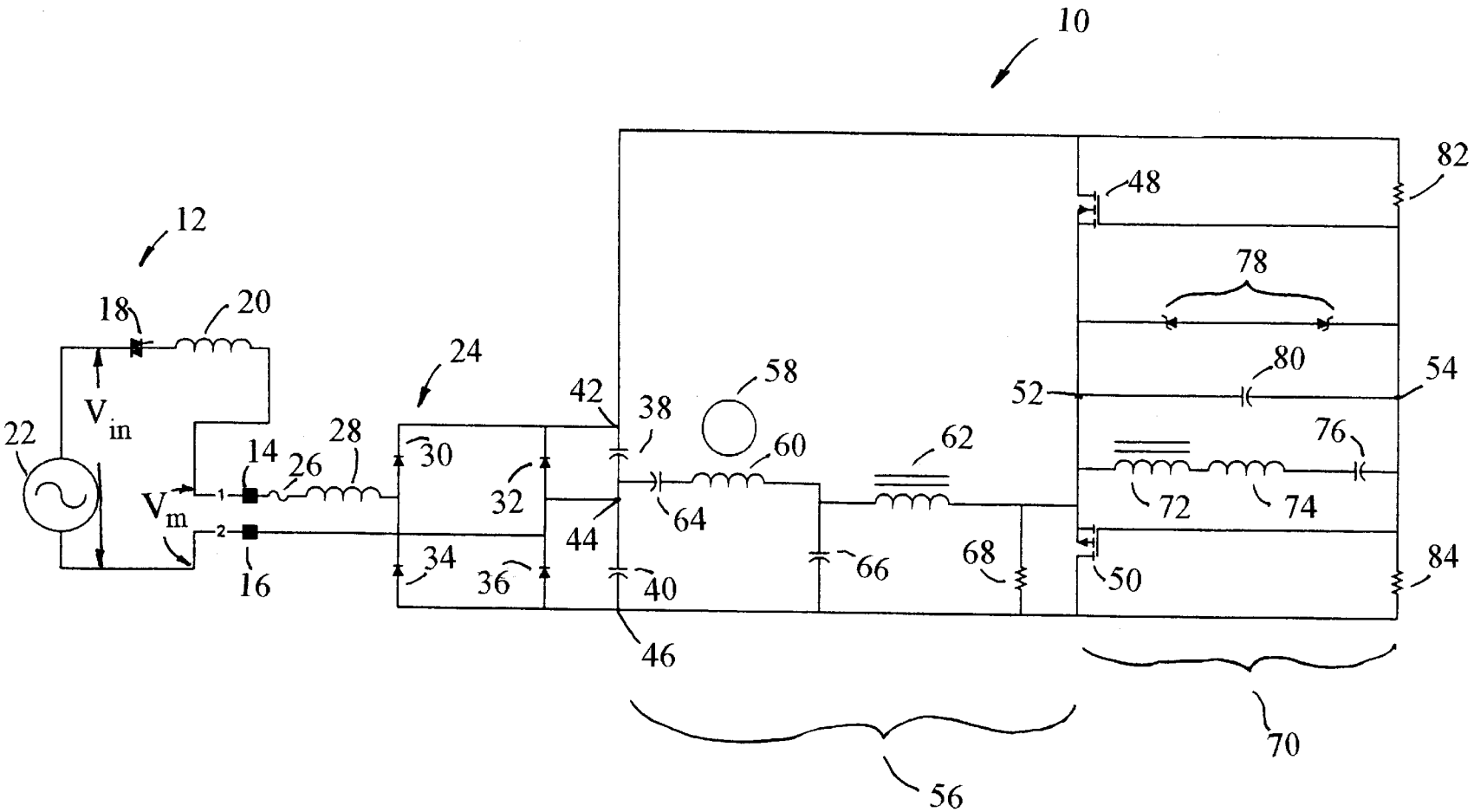
FIG. 1 is a schematic diagram illustrating the concept of a triac dimmable EFL circuit.

FIG. 1 shows a ballast 10 employing features of the invention. Ballast 10 is connected to phase dimmer circuit 12 at dimmer voltage node 14 and reference node 16. Included in dimmer circuit 12 are triac 18 and a first EMI filter 20. Remaining components of dimmer 12 are not shown for reasons of simplicity and clarity since the circuit details of dimmer 12 are not relevant to the present invention. Dimmer 12 is typically a wall mounted dimmer unit connected to an a.c. voltage source 22.

Ballast 10 includes a rectifier circuit 24 comprising a fuse 26 serially connected to a second EMI filter 28 and bridge rectifier diodes 30, 32, 34 and 36 which comprise a standard rectifier bridge circuit. The rectifier bridge circuit is connected to serially connected capacitors 38 and 40 at d.c. bus node 42, intermediate node 44 and ballast reference node 46. A pulsating d.c. bus voltage exists between bus node 42 and reference node 46. A d.c.-to-a.c. converter is realized through the employment of an upper switch 48 and a complementary lower switch 50 serially interconnected at a common node 52. For instance, switch 48 may be an n-channel enhancement mode MOSFET, and switch 50, a p-channel enhancement mode MOSFET, with their sources interconnected at node 52. The gates, or control nodes, of MOSFETs 48 and 50 are interconnected at a control node 54, the voltage between control node 54 and common node 52 determining the conduction state of each switch 48, 50.

Switches 48 and 50 could alternatively be embodied as Insulated Gate Bipolar transistor (IGBT) switches, such as p-channel and n-channel devices respectively. However, each IGBT switch would then be accompanied by a reverse-conducting diode (not shown). Further, switches 48 and 50 could be embodied as Bipolar Junction Transistor (BJT) switches, such as NPN and PNP devices respectively. As with IGBT switches, the BJT switches are respectively accompanied by reverse-conducting diodes A load circuit 56 includes an electrodeless fluorescent lamp 58, which is powered by radio frequency (r.f.) energy supplied by an r.f. inductor 60. Inductor 60 is serially connected with resonant inductor 62 which is in turn connected to node 52. The remaining end of inductor 60 is serially connected with resonant capacitor 64 which is in turn connected to node 44. Capacitors 38 and 40, which are also connected to node 44, cooperate to hold node 44 at a potential between the potential of bus node 42 and reference node 46. This serves to reduce radiated electromagnetic interference from r.f. inductor 60. Capacitors 38 and 40 also act as d.c. blocking capacitors. The junction of inductors 60 and 62 is preferably connected through capacitor 66 to ballast reference node 46. Node 52 is also preferably connected to ballast reference node 46through start-up resistor 68. Lamp 58 may for example be a electrodeless fluorescent lamp, such as a compact electrodeless fluorescent lamp.

A converter control circuit 70 for controlling operation of switches 48 and 50 includes a driving inductor 72 mutually coupled to resonant inductor 62, e.g., a tap from inductor 62, with polarity as indicated by the dots in FIG. 1. Voltage proportional to current in the load circuit is induced in a first driving inductor 72, which, in turn, provides driving power for control circuit 70. Preferably coupled to first driving inductor 72 is a second driving inductor 74. A capacitor 76 is preferably included for initially charging up to a level at which one of switches 48 or 50 turns on.

Control circuit 70 preferably includes a pair of back-to-back Zener diodes 78 to achieve bi-polar voltage level clamping between nodes 52 and 54. A capacitor 80 is also preferably included between nodes 52 and 54 to increase the dead-time intervals when both switches are off. Capacitor 80 is essentially in parallel with capacitor 64 while the latter initially charges up to a level at which one of the switches turns on. For providing power for starting regenerative operation of control circuit 70, a resistor 82 is connected between bus node 42 and control node 54, and a further resistor 84 is connected between reference node 46and control node 54. The resulting resistor network 82, 84 and 68 provides a charging path for capacitor 76 from the bus voltage present between nodes 42 and 46. When the voltage between nodes 54 and 52, or gate-to-source voltage of MOSFET switches 48 and 50, reaches the threshold voltage for the upper switch 48 to turn on, current begins to flow in the load circuit. Such load current is fed back to driving inductor 72 by resonant inductor 62, so that regenerative operation of control circuit 70 occurs.

Figure 2:
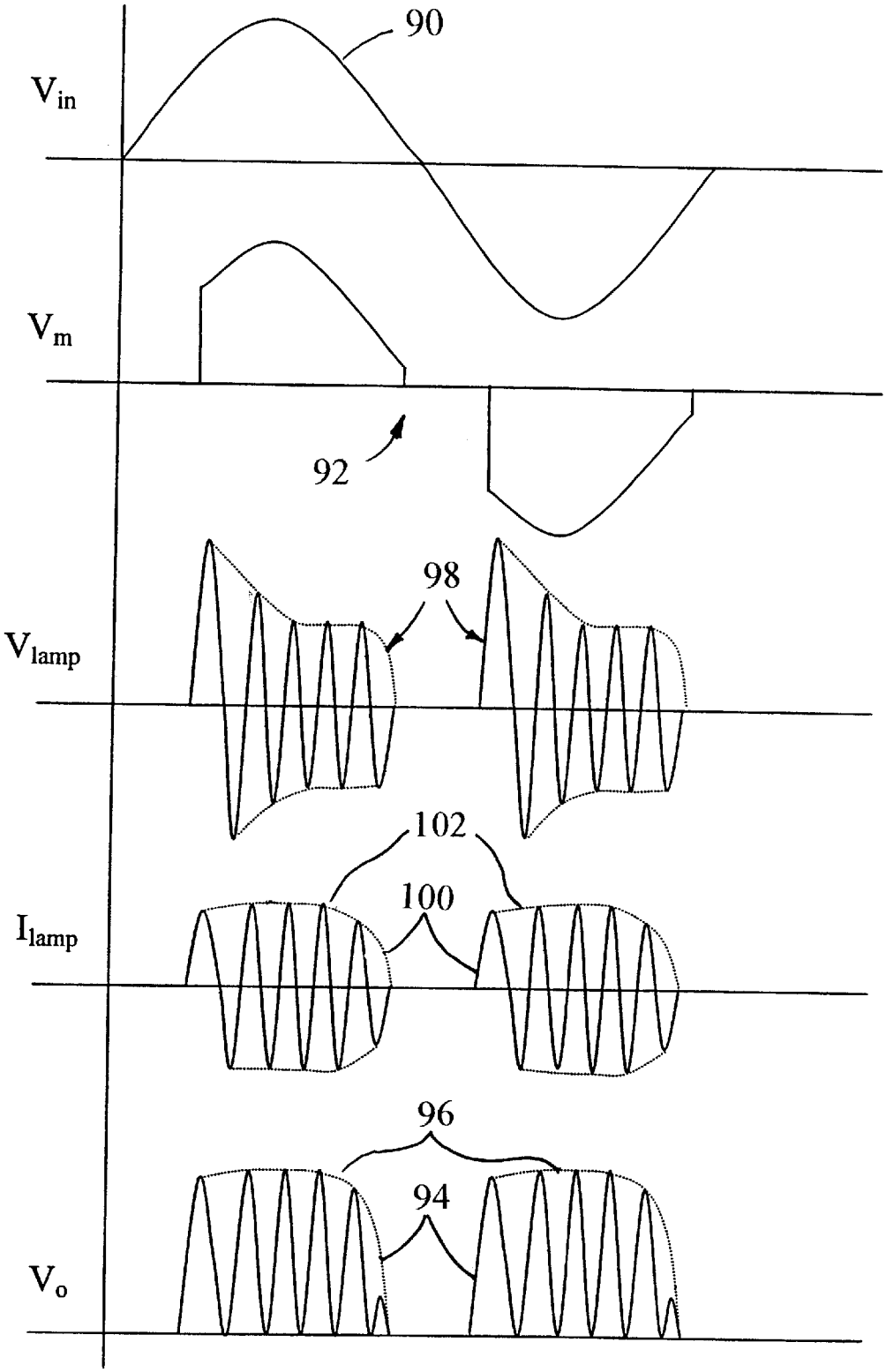
FIG. 2 illustrates signal waveforms of the present invention.

With reference now to FIG. 2, and with continuing reference to FIG. 1, an explanation of the operation of the EFL ballast circuit of FIG. 1 is herein provided. Waveform 90 of FIG. 2 represents $V_{in}$, the input a.c. voltage provided by voltage source 22. It is a nominal 120 volt RMS sinusoidal waveform at 60 Hz. Operation of phase dimmer circuit 12 results in a chopped waveform 92, $V_m$, which is the voltage that appears at node 14 with respect to node 16. This is a typical waveform associated with a wall-mounted phase dimmer. Rectifier circuit 24 acts to rectify $V_m$ and place a pulsating d.c. voltage on bus node 42, with respect to ballast reference node 46. The pulsating d.c. voltage will be similar in form to $V_m$, but rectified, because ballast circuit 10 does not include electrolytic smoothing capacitors typical of prior art EFL ballast circuits. Alternately, if capacitors are included in rectifier circuit 24, such capacitors are preferably "dry-type" capacitors. By "dry-type" capacitor what is meant in the specification and claims is a non-electrolytic capacitor, i.e., a capacitor not using a wet or partially wet electrolyte, which is subject to evaporation and early component failure. Any smoothing effect, however, will be minimal in order to preserve the off, or zero voltage, portion of the input voltage.

In ballast circuit 10, because the d.c. bus voltage at node 42 returns to zero or substantially zero at a frequency twice that of voltage source 22, 120 Hz for example, control circuit 70 is activated only when the d.c. bus voltage exceeds a threshold value sufficient to operate control circuit 70 and switches 48 and 50. Therefore, lamp 58 turns off for a portion of each half-cycle of the supply voltage from source 22, and lamp 58 must then be restarted on each following half-cycle. Waveform 94, $V_o$, illustrates the voltage at node 52, with respect to reference node 46. As shown in FIG. 2, $V_o$ is non-zero only when phase dimmer 12 provides a non-zero voltage $V_m$. An exemplary frequency for $V_o$ when control circuit 70 is operating is approximately 2.5 MHz. The envelope waveform 96 of $V_o$ has a frequency equal to $V_o$, 120 Hz for example. Lamp voltage 98, $V_{lamp}$, and lamp current 100, $I_{lamp}$, are also shown in FIG. 2, and the lamp current envelope 102 shows that lamp 58 is restarted at a frequency equal to twice the frequency of voltage source 22, or 120 Hz for example.

Because phase dimmer 12 varies the conduction angle of the input rectifier circuit 24, causing the inverter control circuit 70 to restart at twice the power line frequency, and because the lamp is restarted at the same frequency and duration for each cycle, the average power applied to the lamp will vary with the conduction angle. Therefore, the average lumens provided by lamp 58 will be a function of the control setting of phase dimmer circuit 12.

Since no wet, or partially wet, electrolyte type capacitors are used in ballast circuit 10, the ballast circuit beneficially provides a dependable, long life ballast at reduced cost.

Thus, in an embodiment of the present application a compact EFL may be dimmed directly from the mains via triac dimming. By removing the electrolytic capacitor from the EFL ballast, and taking advantage of the electrodeless nature of the lamp, a low cost dimmable fluorescent lamp product with a high power at 100% lumens is obtained. Tests undertaken by the inventors show that the lumen output may be adjusted to less than 10%, without visible flicker.

Exemplary component values for the circuit of FIG. 1 are as follows for an electrodeless fluorescent lamp 58 rated at 23 watts, with a a.c. voltage 22 of 120 volts RMS:

Resonant inductor 62 20 micro-henries
Driving inductor 72 0.2 micro-henries
Turns ratio between 62 and 72 35:1
Inductor 74 1.5 micro-henries
Capacitor 80 470 pico-farads
Capacitor 76 22 nano-farads
Zener diodes 78, each 7.5 volts
Resistors 82, 84, 68 270 K ohms
Capacitor 66 680 pico-farads
R.f. Inductor 60 10 micro-henries
D.c. blocking capacitor 64 3.3 nano-farads
Capacitors 38, 40 47 nano-farads In addition, n-channel, enhancement mode MOSFET 48 is sold under the designation IRF210, and p-channel enhancement mode MOSFET 50 under designation IRF9210.

While the invention has been described with respect to specific embodiments by way of illustration, many modifications and changes will occur to those skilled in the art. It is therefore, to be understood that the appended claims are intended to cover all such modifications and changes which fall within the true spirit and scope of the invention.

What is claimed is:

1. A ballast circuit for an electrodeless lamp designed to use a phase dimmer signal to control output of the electrodeless lamp, the dimming ballast circuit comprising:

(a) a rectifier circuit for rectifying an input voltage from a phase dimmer source having a dimmer voltage node and a dimmer reference node, including:

(i) a plurality of rectifier diodes connected in a bridge rectifier arrangement having a pair of input nodes connected to said dimmer voltage node and said dimmer reference node as input;

(ii) an output d.c. bus node; and (iii) an output ballast reference node;

(b) a converter control circuit coupled to said rectifier circuit for inducing an r.f. a.c. load current, said converter comprising:

(i) first and second converter switches serially connected between said bus node and said reference node, being connected together at a common node through which said r.f. a.c. load current flows, and each switch having a control node connected to a common control node, the voltage between said control node and said common node determining the conduction state of each of said switches;

(ii) a first resistor connected between said bus node and said control node;

(iii) a second resistor connected between said reference node and said control node; and (iv) a driving inductor connected at one end to said common node and operatively connected at the remaining end to said control node; and (c) a load circuit including:

(i) a resonant inductor connected at one end to said common node, said resonant inductor being mutually coupled to said driving inductor for sensing a voltage across said resonant inductor;

(ii) an r.f. inductor connected at one end to the remaining end of said resonant inductor for generating an r.f. field for powering said electrodeless lamp;

(iii) a resonant capacitor serially connected to the remaining end of said r.f. inductor, said resonant capacitor connected at the remaining end to an intermediate node, wherein said resonant capacitor is a non-electrolytic capacitor; and (iv) first and second d.c. blocking capacitors connected between said bus node and said reference node, said blocking capacitors being joined with said resonant capacitor at said intermediate node, wherein said blocking capacitors are non-electrolytic capacitors.

2. The ballast circuit of claim 1 further including a second driving inductor serially connected to said driving inductor between said common node and said control node.

3. The ballast circuit of claim 1 further including a bi-directional voltage clamp connected between said common node and said control node.

4. The ballast circuit of claim 3 wherein said bi-directional voltage clamp comprises back-to-back Zener diodes.

5. The ballast circuit of claim 1 further including a first preferred capacitor connected between said common node and said control node.

6. The ballast circuit of claim 1 further including a second preferred capacitor connected between the junction of said r.f. inductor with said resonant inductor and said reference node.

7. The ballast circuit of claim 1 further including a start-up resistor connected between said common node and said reference node.

8. The ballast circuit of claim 1 wherein said control circuit operates at a switching frequency of approximately 2.5 MHz.

9. A ballast circuit designed to use a phase dimmer signal to control output power, the dimming ballast circuit comprising:

(a) a rectifier circuit for rectifying an input voltage from a phase dimmer source having a dimmer voltage node and a dimmer reference node, including:

(i) a plurality of rectifier diodes connected in a bridge rectifier arrangement having a pair of input nodes connected to said dimmer voltage node and said dimmer reference node as input;

(ii) an output d.c. bus node; and (iii) an output ballast reference node;

(b) a converter control circuit coupled to said rectifier circuit for inducing an r.f. a.c. load current, said converter comprising:

(i) first and second converter switches serially connected between said bus node and said reference node, being connected together at a common node through which said r.f. a.c. load current flows, and each switch having a control node connected to a common control node, the voltage between said control node and said common node determining the conduction state of each of said switches;

(ii) a driving inductor connected at one end to said common node and operatively connected at the remaining end to said control node;

(iii) a first capacitor connected between said common node and said control node; and (iv) a bi-directional voltage clamp connected between said common node and said control node; and (c) a load circuit including:

(i) a resonant inductor connected at one end to said common node, said resonant inductor being mutually coupled to said driving inductor for sensing a voltage across said resonant inductor;

(ii) an r.f. inductor connected at one end to the remaining end of said resonant inductor;

(iii) a second capacitor serially connected to the remaining end of said r.f. inductor, said second capacitor connected at the remaining end to an intermediate node;

(iv) an electrodeless lamp connected in parallel with said r.f. inductor, wherein said r.f. inductor generates an r.f. field for powering said electrodeless lamp;

(v) third and fourth capacitors connected between said bus node and said reference node, said intermediate node being connected to the junction of said third and fourth capacitors;

(vi) a fifth capacitor connected between the junction of said r.f. inductor with said resonant inductor and said reference node; and (vii) a start-up resistor connected between said common node and said reference node.

10. The ballast circuit of claim 9 further including a preferred inductor serially connected to said driving inductor between said common node and said control node.

11. The ballast circuit of claim 9 wherein said bi-directional voltage clamp comprises back-to-back Zener diodes.

12. The ballast circuit of claim 9 wherein said control circuit operates at a switching frequency of approximately 2.5 MHz.

13. The ballast circuit of claim 9 wherein said electrodeless lamp restarts at twice the power line frequency.

14. A method of dimming an electrodeless fluorescent lamp energized by a ballast having a d.c.-to-a.c. converter which generates a voltage for an r.f. inductor for energizing the electrodeless fluorescent lamp, the dimming method comprising:

(a) rectifying an input voltage from a phase dimmer source;

(b) providing a rectified voltage with respect to a reference node on a d.c. bus, wherein said providing a rectified voltage is performed without capacitors or with only dry-type capacitors;

(c) activating a switching control circuit when said rectified voltage exceeds a threshold potential, wherein when the control circuit is activated an r.f. a.c. current is generated by complementary switches interconnected to said switching control circuit;

(d) providing said r.f. a.c. current to an r.f. inductor, wherein said r.f. inductor provides power to said electrodeless fluorescent lamp and wherein lumens output from said lamp are altered by the period of time said switching control circuit is activated and wherein said lamp is restarted each time said switching control circuit is activated.

15. The method of dimming an electrodeless fluorescent lamp according to claim 14 wherein said electrodeless fluorescent lamp is restarted at twice the power line frequency.

16. The method of dimming an electrodeless fluorescent lamp according to claim 14 wherein said r.f. a.c. current is generated at a frequency of approximately 2.5 MHz.

* * * * *